US007104814B1

(12) United States Patent
She et al.

(10) Patent No.: US 7,104,814 B1
(45) Date of Patent: Sep. 12, 2006

(54) ELECTRONIC DEVICE WITH SHEATH STRUCTURE

(75) Inventors: Yu-Min She, Taipei (TW); Ing-Hau Lee, Taipei (TW)

(73) Assignee: Inventec Multimedia Telecom Corporation, Taipei (TW)

( * ) Notice: Subject to any disclaimer, the term of this patent is extended or adjusted under 35 U.S.C. 154(b) by 0 days.

(21) Appl. No.: 11/315,282

(22) Filed: Dec. 23, 2005

(51) Int. Cl.
*H01R 13/44* (2006.01)
*H01R 13/60* (2006.01)

(52) U.S. Cl. ..... 439/131; 439/141

(58) Field of Classification Search ..... 439/131, 439/139–141, 136
See application file for complete search history.

(56) References Cited

U.S. PATENT DOCUMENTS 6,116,927 A * 9/2000 Johnson et al. ..... 439/131
6,612,853 B1 * 9/2003 Wu ..... 439/136
6,808,400 B1 * 10/2004 Tu ..... 439/131
6,979,210 B1 * 12/2005 Regen et al. ..... 439/131

* cited by examiner

*Primary Examiner*—Hae Moon Hyeon
(74) *Attorney, Agent, or Firm*—Birch, Stewart, Kolasch and Birch, LLP

(57) ABSTRACT

An electronic device includes a main body having a connection portion for electrically connecting the electronic device to an external device; a sheath for the main body to be slidably received therein; at least one positioning component provided in the sheath, for fixing the main body when the main body is sliding toward a first terminal of the sheath and arrives at a fixing position such that the connection portion is protruded from a first opening formed at the first terminal in order to use the electronic device; and at least one first elastic component provided in the sheath, for pressing the main body to move toward a second terminal of the sheath when the main body is released from the fixing position and is sliding toward the first terminal of the sheath, such that the connection portion is received in the sheath in order to store the electronic device.

8 Claims, 2 Drawing Sheets

ELECTRONIC DEVICE WITH SHEATH STRUCTURE

FIELD OF THE INVENTION

The present invention relates to electronic devices with sheath structures, and more particularly, to an electronic device with a sheath structure for protecting a connection portion of the electronic device.

BACKGROUND OF THE INVENTION

Various computer peripheral devices have been developed in response to the progress of computer information industry. In order to facilitate data sharing and transmission between computer information products, the peripheral devices such as CD-ROM driver, printer, scanner, mobile storage device and so on are externally connected to computers by means of connectors having common connecting interface consistent with Universal Serial Bus (USB) specification or IEEE (Institute of Electrical and Electronics Engineers) 1394 specification, etc. The USB connecting interface has become the important connecting interface for the peripheral devices because it has a much higher transmission rate than that of parallel ports or serial ports of a personal computer and also provides a plug-and-play function for the computer platform. Similarly, the IEEE 1394 connecting interface also has a fast transmission rate at least up to 200 Mb/S and the plug-and-play function.

As there is a need to store more and more data in the form of music and picture files, conventional data storage devices are no longer suitable as not having sufficient data storage capacity. Accordingly, a portable electronic device such as a flash memory hard disk provided with a USB connector serving as data transmission interface, or so-called USB storage device, is proposed. The USB storage device has large data storage capacity, high transmission rate, good portability and low cost and is thus widely used.

Since the USB storage device is connected via a connection portion thereof (i.e. the USB connector) to an external device such as a computer to perform data transmission, if the USB connector is damaged due to external force or impact, the performance of the USB storage device would be adversely affected. Conventional USB storage device utilizes a protective cover to protect the USB connector. As shown in FIG. 1, the protective cover 52 is provided to cover the connection portion 511 of the conventional USB storage device 51 when the USB storage device 51 is not in use. However, during the practical application, as the protective cover 52 must be removed in order to use the USB storage device 51, the protective cover 52 is easily lost, making the connection portion 511 fail to be protected and thereby reducing the lifetime of the USB storage device 51.

Therefore, the problem to be solved here is to provide an electronic device itself having a sheath structure, without having to use a detachable protective cover to protect a connection portion of the electronic device.

SUMMARY OF THE INVENTION

In light of the drawback of the prior art, an objective of the present invention is to provide an electronic device with a sheath structure, for protecting a connection portion of the electronic device by a sheath, without having to use a detachable protective cover that is easily lost.

Another objective of the present invention is to provide an electronic device with a sheath structure, allowing a user to operate easily with one hand to make a connection portion of the electronic device covered by a sheath or exposed from the sheath.

In order to attain the above and other objectives, the present invention proposes an electronic device including: a main body having a connection portion for electrically connecting the electronic device to an external device; a sheath for the main body to be slidably received therein, the sheath comprising a first opening formed at a first terminal of the sheath corresponding to the connection portion, and a second opening formed at a second terminal opposite to the first terminal of the sheath, wherein when the main body is sliding toward the first terminal of the sheath, the connection portion can be protruded from the first opening to a region outside the sheath, and when the main body is sliding toward the second terminal of the sheath, a terminal of the electronic device opposite to the connection portion can be protruded from the second opening to another region outside the sheath; at least one positioning component provided in the sheath, for fixing the main body when the main body is sliding toward the first terminal of the sheath and arrives at a fixing position; and at least one first elastic component provided in the sheath, for pressing the main body to move toward the second terminal of the sheath when the main body is released from the fixing position and is sliding toward the first terminal of the sheath, so as to allow the connection portion to be completely received in the sheath.

Accordingly, the connection portion can be completely received in the sheath when the electronic device is not in use, thereby fully protecting the connection portion from damage due to external force or impact. In the meantime, since the terminal (hereinafter referred to as tail portion) of the electronic device opposite to the connection portion is protruded out of the second opening of the sheath, when a user wishes to use the electronic device, he/she only needs to hold the sheath with one hand and use a finger to press the tail portion of the main body to make the main body slide toward the first opening of the sheath until the connection portion is protruded out of the first opening of the sheath and the main body is fixed at the predetermined fixing position by the positioning component. Therefore, the connection portion of the electronic device is ready to be connected to the external device to perform operation of the electronic device. When the use of the electronic device is finished, the user only needs to release the fixed status of the positioning component, such that the connection portion can be received in the sheath again by means of the elastic force of the first elastic component.

The first elastic component of the electronic device in the present invention is preferably located between the main body and the first terminal of the sheath and at a position relatively closer to the first terminal of the sheath. Thus, when the user uses his/her finger to press the tail portion of the main body to make the main body slide toward the first opening of the sheath, the first elastic component is compressed and provides the elastic force against the main body.

The positioning component of the electronic device in the present invention includes a pressing portion protruded on a surface of the sheath, allowing the main body to be released from the fixing position by pressing the pressing portion; a latching hook portion rotatably provided on an inner side of the sheath and driven by the pressing portion to rotate; and a second elastic component connected to the latching hook portion, for pressing the latching hook portion toward a surface of the main body. The surface of the main body can be formed with a latching hole corresponding to the latching hook portion. When the main body is sliding toward the first terminal of the sheath and arrives at the fixing position, the latching hook portion can be engaged with the latching hole to fix the main body.

The electronic device of the present invention preferably comprises two positioning components, which are mounted symmetrically to an axis of the sheath. This arrangement allows the main body to be more firmly fixed in position and to slide more smoothly. If it is to release the main body from the fixing position, the user only needs to use the thumb and forefinger of one hand to operate the pressing portion of each of the positioning components.

The connection portion of the electronic device in the present invention is preferably consistent with USB specification or IEEE 1394 specification, and the electronic device can be a USB storage device including a memory.

As concluded from the above description, whether the user wishes to use or store the electronic device of the present invention, he/she can easily accomplish it by only using one hand. Further, as the electronic device itself has the sheath for protecting the connection portion, the sheath would not be lost unlike the protective cover of the prior art. Moreover, when it is to use the electronic device, the user presses the tail portion of the main body without touching the connection portion of the main body, thereby preventing the connection portion from being contaminated or damaged.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Preferred embodiments of an electronic device with a sheath structure as proposed in the present invention are described as follows with reference to FIGS. 2A and 2B. The drawings are simplified schematic diagrams and merely illustrate the components pertaining to the invention, and the arrangement of components could be modified as required in practice.

Figure 1:
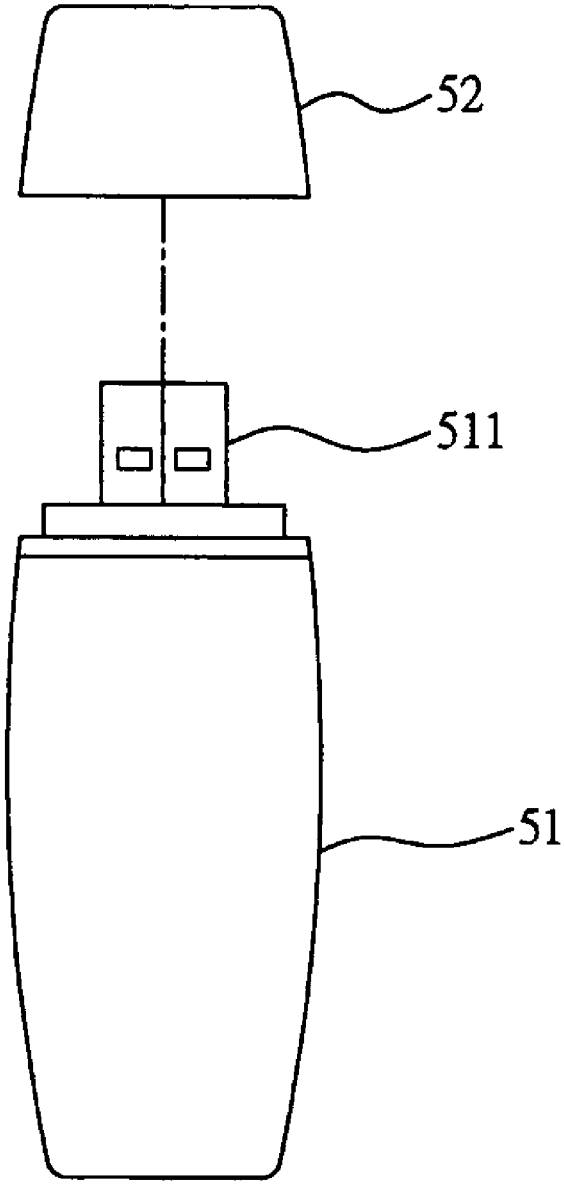
FIG. 1 (PRIOR ART)
FIG. 1 (PRIOR ART) is a schematic diagram of a conventional USB storage device.
Figure 2A:
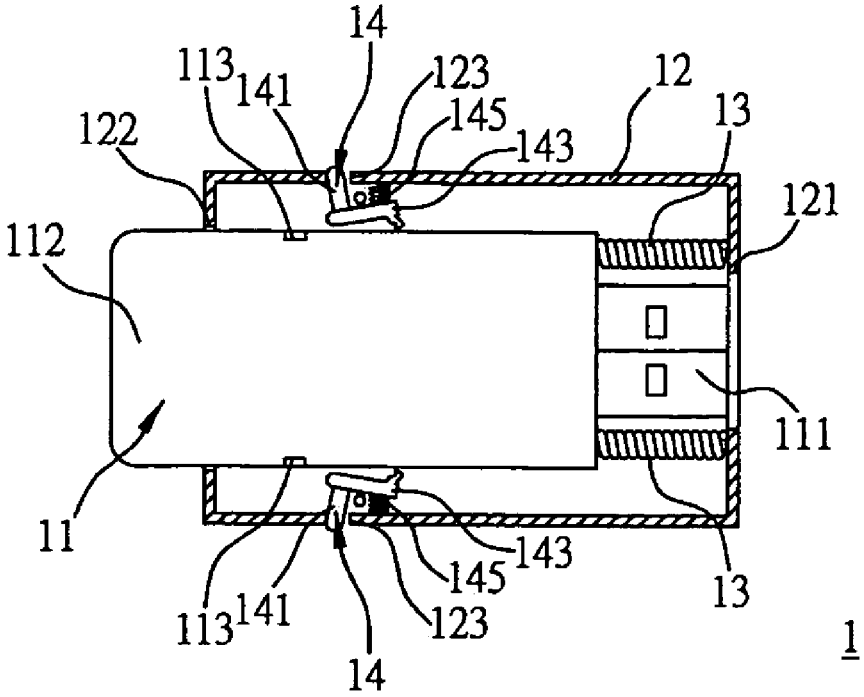
FIG. 2A is a cross-sectional view of an electronic device being stored according to the present invention.

FIG. 2A is a cross-sectional view of the electronic device 1 being stored according to the present invention. FIG. 2B is a cross-sectional view of the electronic device 1 in use. As shown in FIGS. 2A and 2B, the electronic device 1 can be a USB storage device having a memory for storing data. The electronic device 1 comprises a main body 11 having a connection portion 111 consistent with USB specification at a terminal thereof, and a sheath 12 for the main body 11 to be slidably received therein. The sheath 12 comprises a first opening 121 and a second opening 122. Two first elastic components 13, such as compressed coils of springs, are provided in the sheath 12 and at positions relatively closer to the first opening 121. Each of the first elastic components 13 has one end connected to a terminal of the sheath 12 and the other end pressing and abutting against the main body 11. Two positioning components 14 are mounted symmetrically in the sheath 12. Each of the positioning components 14 comprises a pressing portion 141 protruded through an opening 123 on a surface of the sheath 12; a latching hook portion 143 rotatably connected to an inner side of the sheath 12 and driven by the pressing portion 141 to rotate; and a second elastic component 145 connected to the latching hook portion 143, for pressing the latching hook portion 143 to move toward a surface of the main body 11. The surface of the main body 11 is formed with a latching hole 113 corresponding to the latching hook portion 143 and for being engaged with the latching hook portion 143.

Referring to FIG. 2A, when the electronic device 1 is being stored, the first elastic components 13 press the main body 11 to move toward the second opening 122 of the sheath 12, such that a tail portion 112 of the main body 11 opposite to the connection portion 111 is protruded from the second opening 122 to a region outside the sheath 12. A sliding restrained structure (not shown) can be provided between the sheath 12 and the main body 11 to confine a length of the tail portion 112 of the main body 11 protruded out of the sheath 12 to not exceeding a predetermined length. In the meantime, the connection portion 111 of the main body 11 is completely received in the sheath 12 such that the connection portion 111 is being protected.

Figure 2B:
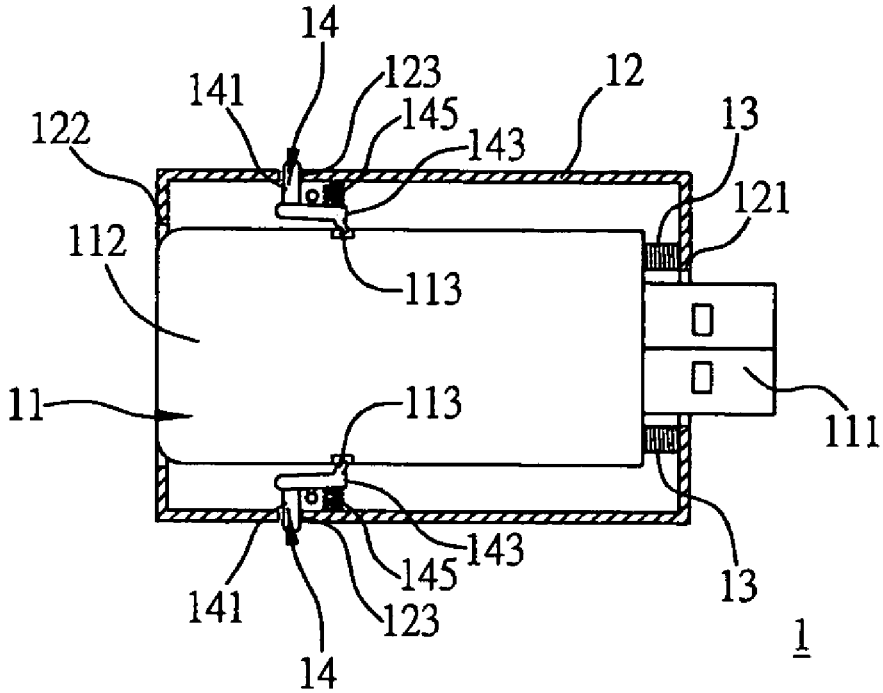
FIG. 2B is a cross-sectional view of the electronic device in use according to the present invention.

Referring to FIG. 2B, if the electronic device 1 is to be used, a user may use a finger to press the tail portion 112 of the main body 11 against the elastic force of the first elastic components 13 to make the main body 11 slide toward the first opening 121 of the sheath 12. When the main body 11 is moved to a fixing position where the latching hole 113 on the surface of the main body 11 corresponds in position to the latching hook portion 143 of each of the positioning components 14, the latching hook portion 143 is pressed toward the surface of the main body 11 by the second elastic component 145 and is inserted into the latching hole 113 to fix the main body 11. In the meantime, the connection portion 111 is protruded out of the first opening 121 of the sheath 12 by a predetermined length, wherein the protruded length of the connection portion 111 is sufficient to insert the connection portion 111 into a corresponding connecting hole of an external device.

When the use of the electronic device 1 is finished and it is ready to store the electronic device 1, the user merely needs to press the pressing portion 141 of each of the positioning components 14 to decouple the latching hook portion 143 from the latching hole 113 on the surface of the main body 11, such that the main body 11 would be moved back to a position for storage by means of the elastic force of the first elastic components 13 to have the connection portion 111 received in the sheath 12.

The invention has been described using exemplary preferred embodiments. However, it is to be understood that the scope of the invention is not limited to the disclosed embodiments. On the contrary, it is intended to cover various modifications and similar arrangements. For example, the connection portion of the main body is not limited to one consistent with the USB specification but can also be a connection portion consistent with IEEE 1394 specification or any other specification. The scope of the claims, therefore, should be accorded the broadest interpretation so as to encompass all such modifications and similar arrangements.

What is claimed is:

1. An electronic device comprising:

a main body having a connection portion for electrically connecting the electronic device to an external device;

a sheath for the main body to be slidably received therein, the sheath comprising:

a first terminal corresponding to the connection portion;

a first opening formed at the first terminal of the sheath, for allowing the connection portion to pass through the first opening and reach a region outside the sheath when the main body is sliding toward the first terminal of the sheath;

a second terminal opposite to the first terminal; and a second opening formed at the second terminal of the sheath, for allowing a terminal of the electronic device opposite to the connection portion to pass through the second opening and reach another region outside the sheath when the main body is sliding toward the second terminal of the sheath;

at least one positioning component provided in the sheath, for fixing the main body when the main body is sliding toward the first terminal of the sheath and arrives at a predetermined fixing position; and at least one first elastic component provided in the sheath, for pressing the main body to move toward the second terminal of the sheath when the main body is released from the fixing position and is sliding toward the first terminal of the sheath, so as to allow the connection portion to be completely received in the sheath.

2. The electronic device of claim 1, wherein the first elastic component is located between the main body and the first terminal of the sheath and at a position close to the first terminal of the sheath.

3. The electronic device of claim 1, wherein the positioning component comprises a pressing portion protruded on a surface of the sheath, for releasing the main body from the fixing position.

4. The electronic device of claim 3, wherein the positioning component further comprises:

a latching hook portion rotatably provided on an inner side of the sheath and driven by the pressing portion to rotate; and a second elastic component connected to the latching hook portion, for pressing the latching hook portion to move toward a surface of the main body.

5. The electronic device of claim 4, wherein the surface of the main body is formed with a latching hole corresponding to the latching hook portion, allowing the latching hole to be engaged with the latching hook portion to fix the main body when the main body is sliding toward the first terminal of the sheath and arrives at the fixing position.

6. The electronic device of claim 1, wherein the at least one positioning component comprises two positioning components mounted symmetrically to an axis of the sheath.

7. The electronic device of claim 1, wherein the connection portion is consistent with one of Universal Serial Bus (USB) specification and IEEE 1394 specification.

8. The electronic device of claim 1, wherein the main body is a USB storage device including a memory.

* * * * *